US009487027B1

(12) United States Patent
Strater, Jr. et al.

(10) Patent No.: US 9,487,027 B1
(45) Date of Patent: Nov. 8, 2016

(54) SINGLE PASS INKJET METHOD OF APPLYING AN ADHESIVE TO A SUBSTRATE TO BOND A FOIL MATERIAL TO THE SUBSTRATE

(71) Applicants: William H. Strater, Jr., Vero Beach, FL (US); Markus Portmann, Vero Beach, FL (US)

(72) Inventors: William H. Strater, Jr., Vero Beach, FL (US); Markus Portmann, Vero Beach, FL (US)

(73) Assignee: GRAPH-TECH-USA, LLC, Fort Pierce, FL (US)

( * ) Notice: Subject to any disclaimer, the term of this patent is extended or adjusted under 35 U.S.C. 154(b) by 0 days.

(21) Appl. No.: 14/718,115

(22) Filed: May 21, 2015

(51) Int. Cl.
*B41J 11/00* (2006.01)

(52) U.S. Cl.
CPC ..... *B41J 11/0015* (2013.01); *B41J 11/002* (2013.01)

(58) Field of Classification Search
None
See application file for complete search history.

(56) References Cited

U.S. PATENT DOCUMENTS 6,957,030 B2 * 10/2005 Baker, Jr. ..... B41M 5/0256 399/147
2006/0194024 A1 * 8/2006 Nakayama ..... B32B 3/14 428/172
2013/0314470 A1 * 11/2013 Igawa ..... B41J 2/01 347/20

* cited by examiner

*Primary Examiner* — Justin Seo
(74) *Attorney, Agent, or Firm* — Raj Abhyanker, P.C.

(57) ABSTRACT

A method of single pass inkjet method of applying an adhesive to a substrate to bond a foil material to the substrate is disclosed. The inkjet printer includes a printer head to pattern an adhesive material directly onto a printable substrate and a foil material. An ultraviolet curing lamp is included to cure the adhesive material using a dry lamination process and/or a wet lamination process. A nip roller is included to affix the foil material with the adhesive material onto to the printable substrate. A rollback mechanism is assembled to lift away excess foil material from the printable substrate and the excess foil material is adjacent to fully cured areas of the adhesive material having the affixed thereupon the foil material.

20 Claims, 8 Drawing Sheets

SINGLE PASS PRINTING OVERVIEW 250

SINGLE PASS INKJET METHOD OF APPLYING AN ADHESIVE TO A SUBSTRATE TO BOND A FOIL MATERIAL TO THE SUBSTRATE

FIELD OF TECHNOLOGY

This disclosure relates generally to printing and, more particularly, to a method and/or a device of a single pass inkjet method of applying an adhesive to a substrate to bond a foil material to the substrate.

BACKGROUND

Specialized print effects (e.g., metallic textures, scratch off surfaces, holofoils, glitter effects, mirrored surfaces) on a printed material (e.g., a plastic card, a paper, a poster) may be eye-catching and desired by customers. Further, specialized print effects may add a sense of higher value to different types of printing (e.g., book covers, promotional items, labels, posters).

However, the printing of specialized print effects may require complex and expensive screen printing methods. Screen printing methods might involve extensive set up and/or preparation time. As a result, screen printing may not lend itself to low quantity printing. Moreover, screen printing equipment may be expensive to purchase and maintain. Even more troubling is that inkjet technology might not be well suited for specialized printing. For example, specialized inks may not work properly in inkjet printers. Specialized inks may be highly reflective and created with large flakes of abrasive-edged metal causing damage and clogging in inkjet print heads. Further, such inks may have undesired dithering, spluttering, dot gain, smear, and resolution loss effects. Therefore, significant market opportunities may be lost.

SUMMARY

Disclosed are a method and/or a device of a single pass inkjet method of applying an adhesive to a substrate to bond a foil material to the substrate.

In one aspect, an inkjet printer includes a printer head to pattern an adhesive material directly onto a printable substrate and a foil material responsive to a digital data received from a computing system in a single pass process. The inkjet printer also includes an ultraviolet pinning lamp to transform the adhesive material to a partially cured state, such that the adhesive material to retain an ability to affix onto the foil material and the printable substrate.

In addition, the inkjet printer includes a nip roller to affix the foil material with the adhesive material transformed into the partially cured state through the ultraviolet pinning lamp onto to the printable substrate. Moreover, the inkjet printer includes an ultraviolet curing lamp to fully cure the adhesive material having the affixed thereupon the foil material. Furthermore, the inkjet printer includes a rollback mechanism to lift away excess foil material from the printable substrate. The excess foil material is adjacent to fully cured areas of the adhesive material having the affixed thereupon the foil material.

The printer head may simultaneously deposit a pigmented ink and/or the adhesive material during the single pass process. A substrate may continuously feed through the inkjet printer in a forward fashion at a constant rate of speed during operation of the inkjet printer to facilitate high speed inkjet printing tasks. The single pass process may deposit the adhesive material and/or the pigmented ink, at a rate matching the constant rate of speed of the substrate feeding through the inkjet printer in the forward fashion.

The printer head may be a single unit which is wide enough to cover a width of a substrate area on which the adhesive material may be deposited onto the substrate. The printer head may be constructed from multiple individual print heads each serially coupled with each other to form the print head. The substrate may be a plastic card, a paper stock, a wood material, a metallic material, a polymer based surface, an organic surface, a cloth material, a ceramic material, and/or a magnetic material.

The print head may be a monochromatic print head, a single purpose adhesive print head, a multifunctional print head, and/or a multicolor print head. The ultraviolet pinning lamp may operate between 2 and 4 watts per centimeter square (4 $W/cm^2$) and the ultraviolet curing lamp may operate at 12 watts per centimeter square (12 $W/cm^2$). The foil material may produce a specialized print effect demonstrating crisp characters and/or graphics through the partial curing through the ultraviolet pinning lamp. The specialized print effect created with the foil material may be a metallic texture, a scratch off surface, a holofoil, a glitter effect, and/or a mirrored surface effect. The foil material may be any one of a hot transfer foil and/or a cold transfer foil.

The inkjet printer may demonstrate the fast curing benefits of a wet lamination process while minimizing risks of ink surface tension and/or mechanical speed matching of a dry lamination process. The adhesive material may be comprised of 5-20% hexanediol diacrylate, 5-30% alkoxylated monomer diacrylate, 5-50% vinylcaprolactam, 30-50% triacrylate monomer, 1-10% phosphine oxide, and/or 0-7% carbon color material compound. The adhesive material may be producible in a color form, an opaque form, a translucent form, and/or a transparent form.

In another aspect, an inkjet printer includes a printer head to pattern an adhesive material directly onto a printable substrate and a foil material responsive to a digital data received from a computing system in a single pass process. The inkjet printer also includes an ultraviolet curing lamp to cure the adhesive material using a dry lamination process and/or a wet lamination process. In addition, the inkjet printer includes a nip roller to affix the foil material with the adhesive material onto to the printable substrate. Moreover, the inkjet printer includes a rollback mechanism to lift away excess foil material from the printable substrate. The excess foil material is adjacent to fully cured areas of the adhesive material having the affixed thereupon the foil material.

In yet another aspect, a method includes patterning an adhesive material directly onto a printable substrate and a foil material responsive to a digital data received from a computing system in a single pass process using a processor and a memory. The method also includes transforming the adhesive material to a partially cured state through an ultraviolet pinning lamp such that the adhesive material to retain an ability to affix onto the foil material and the printable substrate.

In addition, the method includes affixing the foil material with the adhesive material transformed into the partially cured state through the ultraviolet pinning lamp onto to the printable substrate. Moreover, the method includes fully curing the adhesive material having the affixed thereupon the foil material. Furthermore, the method includes lifting away excess foil material from the printable substrate. The excess foil material is adjacent to fully cured areas of the adhesive material having the affixed thereupon the foil material.

The methods and devices disclosed herein may be implemented in any means for achieving the various aspects, and may be executed in the form of a non-transitory machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

Example embodiments are illustrated by way of example and not limitation in the figures of the accompanying drawings, in which like references indicate similar elements and in which.

Figure 1:
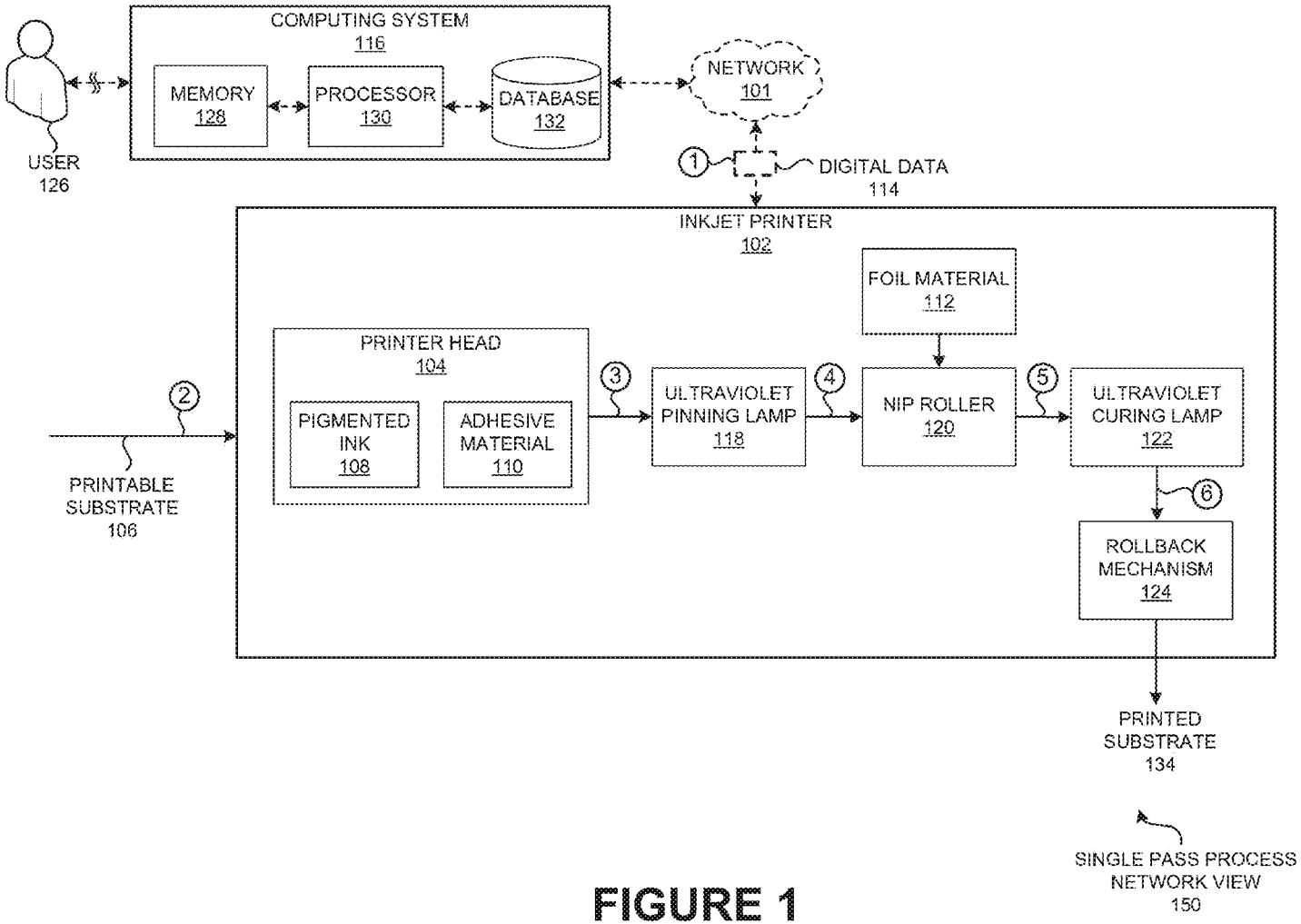
FIG. 1 is a single pass process network view of applying an adhesive material to a substrate to bond a foil material to the printable substrate, according to one embodiment.

Other features of the present embodiments will be apparent from the accompanying drawings and from the detailed description that follows.

DETAILED DESCRIPTION

Example embodiments, as described below, may be used to provide a method, and/or a device of a single pass inkjet method of applying an adhesive to a substrate to bond a foil material to the substrate.

In one embodiment, an inkjet printer 102 includes a printer head 104 to pattern an adhesive material 110 directly onto a printable substrate 106 and a foil material 112 responsive to a digital data 114 received from a computing system 116 in a single pass process. The inkjet printer 102 also includes an ultraviolet pinning lamp 118 to transform the adhesive material 110 to a partially cured state 202, such that the adhesive material 110 to retain an to affix onto the foil material 112 and the printable substrate 106.

In addition, the inkjet printer 102 includes a nip roller 120 to affix the foil material 112 with the adhesive material 110 transformed into the partially cured state 202 through the ultraviolet pinning lamp 118 onto to the printable substrate 106. Moreover, the inkjet primer 102 includes an ultraviolet curing lamp 122 to fully cure the adhesive material 110 having the affixed thereupon the foil material 112. Furthermore, the inkjet printer 102 includes a rollback mechanism 124 to lift away excess foil material 206 from the printable substrate 106. The excess foil material 206 is adjacent to fully cured areas of the adhesive material 110 having the affixed thereupon the foil material 112.

The printer head 104 may simultaneously deposit a pigmented ink 108 and/or the adhesive material 110 during the single pass process. A substrate may continuously feed through the inkjet printer 102 in a forward fashion at a constant rate of speed during operation of the inkjet printer 102 to facilitate high speed inkjet panting tasks. The single pass process may deposit the adhesive material 110 and/or the pigmented ink 108, at a rate matching the constant rate of speed of the substrate feeding through the inkjet printer 102 in the forward fashion.

The printer head 104 may be a single unit which is wide enough to cover a width of a substrate area on which the adhesive material 110 may be deposited onto the substrate. The printer head 104 may be constructed from multiple individual print heads each serially coupled with each other to form the pint head. The printable substrate 106 may be a plastic card, a paper stock, a wood material, a metallic material, a polymer based surface, an organic surface, a cloth material, a ceramic material, and/or a magnetic material.

The printer head 104 may be a monochromatic print head, a single purpose adhesive print head, a multifunctional print head, and/or a multicolor print head. The ultraviolet pinning lamp 118 may operate between 2 and 4 watts per centimeter square (4 $W/cm^2$) and the ultraviolet curing lamp 122 may operate at 12 watts per centimeter square (12 $W/cm^2$). The foil material 112 may produce a specialized print effect demonstrating crisp characters and/or graphics through the partial curing through the ultraviolet pinning lamp 118. The specialized print effect created with the foil material 112 may be a metallic texture, a scratch off surface, a holofoil, a glitter effect, and/or a mirrored surface effect. The foil material 112 may be any one of a hot transfer foil and/or a cold transfer foil.

UV pinning may be the process of applying a dose of low intensity ultraviolet (UV) light to a UV curable ink (UV ink). The light's wavelengths may be correctly matched to the ink's photochemical properties. As a result, the ink droplets may move to a higher viscosity state, but may stop short of full cure. This is process may be referred to as the "gelling" of the ink. UV pinning may be used in UV ink jet applications (e.g. the printing of labels, the printing of electronics, and the fabrication of 3-D microstructures), according to the various embodiments described herein. UV pinning may enhance the management of drop size and/or image integrity utilizing the various embodiments described herein, thereby minimizing the unwanted mixing of drops and providing the highest possible image quality and the sharpest color rendering.

In typical print process' such as flexographic and offset printing, the foil transfer adhesive may be applied in contact method which squeezes the ink out in a controlled dot gain and a relatively thin layer which will not have any substantial spread when the foil is "nipped" prior to full cure. Ink jet used in digital printing applications by their nature may require very low viscosity for jetting with relatively high deposit volume that may spread substantially when the foil is "nipped" prior to full cure. Without the pinning operation, the adhesive ink may spread substantially during the foil application step ruining the quality of the finished image.

By pinning the inkjet adhesive according to the various embodiments described herein, the "gelled" adhesive may hold its intended printed shape but still may allow the foil to be nipped to the substrate prior to final cure need prior to the film rollback. Pinning the adhesive in accordance with the various embodiments described herein may potentially help image quality even in non-digital print applications, but the nature of the inkjet adhesive viscosity, volume, and/or noncontact application makes it critical for finished image quality in various aspects of the embodiments described herein.

The inkjet printer 102 may demonstrate the fast curing benefits of a wet lamination process while minimizing risks of ink surface tension and/or mechanical speed matching of a dry lamination process. The adhesive material 110 may be comprised of 5-20% hexanediol diacrylate, 5-30% alkoxylated monomer diacrylate, 5-50% vinylcaprolactam, 30-50% triacrylate monomer, 1-10% phosphine oxide, and/or 0-7% carbon color material compound. The adhesive material 110 may be producible in a color form, an opaque form, a translucent form, and/or a transparent form.

In another embodiment, an inkjet printer 102 includes a printer head 104 to pattern an adhesive material 110 directly onto a printable substrate 106 and a foil material 112 responsive to a digital data 114 received from a computing system 116 in a single pass process. The inkjet printer 102 also includes an ultraviolet curing lamp 122 to cure the adhesive material 110 using a dry lamination process and/or a wet lamination process. In addition, the inkjet printer 102 includes a nip roller 120 to affix the foil material 112 with the adhesive material 110 onto to the printable substrate 106. Moreover, the inkjet printer 102 includes a rollback mechanism 124 to lift away excess foil material 206 from the printable substrate 106. The excess foil material 206 is adjacent to fully cured areas of the adhesive material 110 having the affixed thereupon the foil mate 112.

In yet another embodiment, a method includes patterning an adhesive material 110 directly onto a printable substrate 106 and a foil material 112 responsive to a digital data 114 received from a computing system 116 in a single pass process using a processor 130 and a memory 128. The method also includes transforming the adhesive material 110 to a partially cured state 202 through an ultraviolet pinning lamp 118 such that the adhesive material 110 to retain an ability to affix onto the foil material 112 and the printable substrate 106.

In addition, the method includes affixing the foil material 112 with the adhesive material 110 transformed into the partially cured state 202 through the ultraviolet pinning lamp 118 onto the printable substrate 106. Moreover, the method includes fully curing the adhesive material 110 having the affixed thereupon the foil material 112. Furthermore, the method includes lifting away excess foil material 206 from the printable substrate 106. The excess foil material 206 is adjacent to fully cured areas of the adhesive material 110 having the affixed thereupon the foil material 112.

FIG. 1 is a single pass process network view of applying an adhesive material to a substrate to bond a foil material to the printable substrate, according to one embodiment. Particularly, FIG. 1 shows a network 101, an inkjet printer 102, a printer head 104, a printable substrate 106, a pigmented ink 108, an adhesive material 110, a foil material 112, a digital data 114, a computing system 116, an ultraviolet pinning lamp 118, a nip roller 120, an ultraviolet curing lamp 122, a rollback mechanism 124, an user 126, a memory 128, a processor, a database 132, and a printed substrate 134, according to one embodiment.

A network 101 may be a group of computing devices (e.g., hardware and software) that are linked together through communication channels to facilitate communication and resource-sharing among a wide range of entities (e.g., inkjet printer 102). An inkjet printer 102 may be an output device that prints ink on to a substrate material. The inkjet printer 102 may physically manifest a digital data 114 by propelling droplets of pigmented ink 108 and adhesive material 110 on a printable substrate 106. The inkjet printer 102 may affix a foil material 112 with the adhesive material 110 onto the printable substrate 106 and is then fully cured using an ultraviolet curing lamp 122 in a single pass process, according to one embodiment.

A printer head 104 (also known as print head) may be a component that forms a printed character onto the printable substrate 106. The print head may be a single unit or may be constructed from multiple individual print heads each serially coupled with each other to form a print head. The printer head 104 may be wide enough to cover a width of a printable substrate 106 area on which the pigmented ink 108 and/or adhesive material 110 may be deposited. The printer head 104 may deposit the pigmented ink 108 as well as the adhesive material 110 through different nozzles on a printable substrate 106 in a single pass process. The printer head 104 may print the adhesive material 110 only on the required area of printable substrate 106. A printer head 104 may be a monochromatic print head, a single purpose adhesive print head, a multifunctional print head, and/or a multicolor print head, according to one embodiment.

A monochromatic print head may be a printer head 104 with a single color to print the digital data 114 provided by the user 126 on the printable substrate 106. The multicolor print head may be a printer head 104 with more than one color to print the digital data 114 provided by the user 126 on the printable substrate 106. The single purpose adhesive print head may be the printer head 104 with an adhesive storage to apply them onto the printable substrate 106. The multifunctional print head may be a print head with both the color print head and adhesive print head assembled into a single print head. This may provide both the pigmented ink 108 and adhesive material 110 simultaneously onto the printable substrate 106 during printing, according to one embodiment.

A printable substrate 106 may be a base material onto which the pigmented ink 108 is fed through the nozzles of printer head 104 to print the given digital data 114 and the adhesive material 110 to affix the foil material 112 on it. A printable substrate 106 may be a plastic card, a paper stock, a wood material, a metallic material, a polymer based surface, an organic surface, a cloth material, a ceramic material and/or a magnetic material. A pigmented ink 108 may be a specialized ink which is used by inkjet printer 102 to print the digital data 114 provided by the user 126 through computing system 116 on a printable substrate 106, according to one embodiment. The pigmented ink 108 may solve a problem in today's credit cards, according to one embodiment. For example, embossed cards may use a metallic and/or colored "Tipping Foil" for aesthetics which may wear off quickly making the text difficult to read. In one embodiment, if the foil adhesive is white and/or some other color different than the background even as foil wears, the information (e.g., numbering, lettering) may still be legible.

An adhesive material 110 may be a substance deposited from a printer head 104 simultaneously with the pigmented ink 108 at a rate matching the constant speed of the printable substrate 106 feeding through the inkjet printer 102 in the forward fashion. The adhesive material 110 may be applied to the surface of the printable substrate 106 to bind the foil material 112 with the printable substrate 106 after passing through the fully cured state 204. Different adhesive material(s) 110 may be used for different types of lamination process. The adhesive material 110 may be comprised of 5-20% hexanediol diacrylate, 5-30% alkoxylated monomer diacrylate, 5-50% vinylcaprolactam, 30-50% triacrylate monomer, 1-10% phosphine oxide, and/or 0-7% carbon color material compound. The adhesive material 110 may be producible in a color form, an opaque form, a translucent form, and/or a transparent form, according to one embodiment.

A foil material 112 may be a sheet affixed onto a printable substrate 106 using an adhesive material 110 by passing through a nip roller 120. The foil material 112 may be used to produce a specialized print effect demonstrating crisp characters and graphics through the partial curing through the ultraviolet pinning lamp 118. The specialized print effect created with the foil material 112 may be a metallic texture, a scratch off surface, a holofoil, a glitter effect, and/or a mirrored surface effect. The foil material 112 may be a hot transfer foil and/or a cold transfer foil. A digital data 114 may be digital information which the user 126 wants in a printed form on a printable substrate 106 in a single pass process. The digital data 114 may allow the content being printed to be highly variable, and quickly changeable. Unlike traditional approaches, by utilizing the various embodiments described herein, the digital process (e.g., by outputting the digital data 114) may allow a printer to create foil shapes, styles, layouts, and patterns of unlimited possibilities, without requiring costly set up or extensive time. New data files may be able to produce output of any pattern or shape, even when printing is done in low quantities through the digital data 114, providing for a significant advantage and cost savings over prior art.

Moreover, utilizing a digital process through the digital data 114 in accordance with the various embodiments described herein may provide advantages including eliminating many mechanical steps required in conventional printing (e.g., making films, color proofs, manually stripping pieces together, making plates). A computing system 116 may be a system that shares a central storage system and various peripheral devices. The computing system 116 transfers the digital data 114 to inkjet printer 102 to print of a printable substrate 106 through a network 101 in a single pass process, according to one embodiment.

An ultraviolet pinning lamp 118 may be a lamp used at an initial stage to transform the adhesive material 110 to partially cure state. The pinning lamp may be operated between 2 and 4 watts per centimeter square (2 W/cm$^2$ and 4 W/cm$^2$) of curing intensity. As a result, the UV cured pigmented ink 108 droplets may move to a higher viscosity state to retain the ability of the adhesive material 110 to affix onto the foil material 112 and the printable substrate 106. A nip roller 120 may be a powered roll used to press and affix a foil material 112 with the adhesive material 110 transformed into a partially cured state 202 through the ultraviolet pinning lamp 118 onto to the printable substrate 106 to form a laminated product. The high pressure created at the nip points brings the printable substrate 106 and the foil material 112 into intimate contact without causing any defective bond. Nip rolls can be used to laminate sheets using wet adhesives, film adhesives, etc., according to one embodiment.

An ultraviolet curing lamp 122 may be a lamp used to fully cure and/or dry the ink and the adhesive material 110 affixed thereupon the foil material 112. The curing lamp may be operated approximately 12 watts per centimeter square (12 W/cm$^2$) of curing intensity. As a result, a high intensity ultraviolet light is used to create a photochemical reaction that may instantly cure the pigmented ink 108 and adhesive material 110. A rollback mechanism 124 may be used to lift away the excess foil material 206 from the printable substrate 106. The excess foil material 206 may be adjacent to fully cured areas of the adhesive material 110 having the affixed thereupon the foil material 112, according to one embodiment.

A user 126 may be a person who operates a computer system and process the digital data 114 for printing from the inkjet printer 102 as per the requirement. A memory 128 may be an electronic holding place for instructions and digital data 114 that the processor 130 of the computing system 116 can reach quickly to print onto the printable substrate 106. A processor 130 may be a logic circuitry that responds to and processes the basic instructions provided by the user 126 to print the digital data 114 onto the printable substrate 106. A database 132 may be a structured collection of information and digital data 114 to print onto the printable substrate 106 by an inkjet printer 102. A printed substrate 134 may be an output substrate from the inkjet printer 102 onto which the pigmented ink 108, adhesive material 110 fully cured and foil material 112 with special printing effects are already applied, according to one embodiment.

A computing system 116 operated by the user 126 may be communicatively coupled with the inkjet printer 102 through a network 101. The computing system 116 may include a processor 130 which may be communicatively coupled with a memory 128 and a database 132. The inkjet printer 102 may include a printer head 104 (e.g., monochromatic print head, a single purpose adhesive print head, a multifunctional print head, and/or a multicolor print head), an ultraviolet pinning lamp 118, a nip roller 120, an ultraviolet curing lamp 122 and a rollback mechanism 124 to end this process, according to one embodiment.

FIG. 1 illustrates operations circle '1', through circle '6'. First, in circle '1', the user 126 may forward the digital data 114 to the inkjet printer 102 from the computing device through a network 101, according to one embodiment. In circle '2', the printable substrate 106 may be allowed to pass under the printer head 104 to apply the pigmented ink 108 and the adhesive material 110 simultaneously onto the printable substrate 106. In one embodiment, the printer head 104 may be constructed using multiple individual printer head(s) 104 each serially coupled with each other to form a print head. The printer head 104 may be a monochromatic print head, a single purpose adhesive print head, a multifunctional print head, and/or a multicolor print head, according to one embodiment.

In circle '3', the printable substrate 106 with the pigmented ink 108 may be allowed to pass under the ultraviolet pinning lamp 118. The ultraviolet pinning lamp 118 may retain the ability of adhesive material 110 to affix the foil material 112 onto the printable substrate 106 by operating between 2 and 4 watts per centimeter square (2 W/cm$^2$ and 4 W/cm$^2$), according to one embodiment. In circle '4', a foil material 112 may be allowed to affix with the adhesive material 110 in partially cured state 202 through the ultraviolet pinning lamp 118 onto the printable substrate 106 to form a laminated product, according to one embodiment.

In circle '5', the printable substrate 106 may be allowed to pass under an ultraviolet curing lamp 122 to fully cure the adhesive material 110 and make the foil material 112 properly affix onto the printable substrate 106. The adhesive material 110 may be operated on approximately 12 watts per centimeter square (12 W/cm$^2$), according to one embodiment. Finally circle '6', illustrates the printable substrate 106 which may be further allowed to pass through rollback mechanism 124 to collect the excess foil material 206 in a different roller. The excess foil material 206 may be adjacent to fully cured areas of the adhesive material 110 having the affixed thereupon the foil material 112, according to one embodiment.

Figure 2:
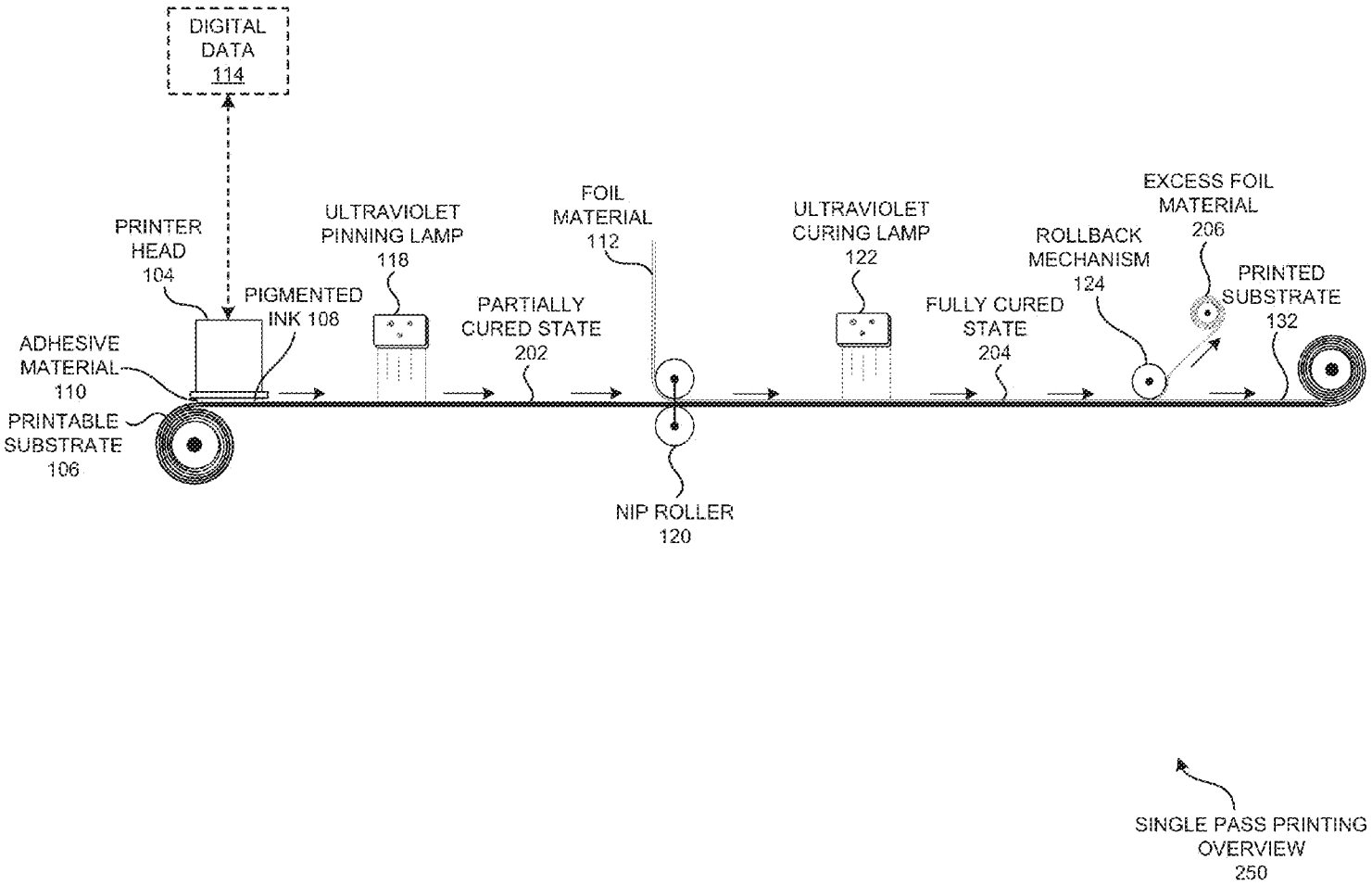
FIG. 2 is the single pass printing overview of a wet lamination process involved in printing on the printable substrate of FIG. 1, according to one embodiment.

FIG. 2 is the single pass printing overview of a wet lamination process involved in printing on the printable substrate of FIG. 1, according to one embodiment. Particularly, FIG. 2 shows a partially cured state 202, a fully cured state 204, and an excess foil material 206, according to one embodiment. A partially cured state 202 may be a state where the printable substrate 106 with pigmented ink 108 and adhesive material 110 applied is allowed to pass under ultraviolet pinning lamp 118. The adhesive material 110 may be treated between 2 and 4 watts per centimeter square (2 W/cm$^2$ and 4 W/cm$^2$) of low curing intensity. This may result to retain the ability of adhesive material 110 and make it ready to affix onto the foil material 112 and the printable substrate 106, according to one embodiment.

A fully cured state 204 may be a state where the printable substrate 106 with a foil material 112 affixed through nip roller 120 is allowed to pass under an ultraviolet curing lamp 122. The adhesive material 110 partially cured onto the printable substrate 106 may be treated under approximately 12 watts per centimeter square (12 W/cm$^2$) of high curing intensity. This may result to fully cure the adhesive material 110 on the printable substrate 106 with the affixed foil material 304. The excess foil material 206 may be the foil material 112 left after fully curing the adhesive material 110 of the printable substrate 106, which is then rolled back to different roller, according to one embodiment.

An ultraviolet curing lamp 122 may provide a high intensity ultraviolet light to create a photochemical reaction to cure the adhesive material 110 using a dry lamination process and/or a wet lamination process. The inkjet printer 102 may demonstrate the fast curing benefits of a wet lamination process while minimizing risks of ink surface tension and mechanical speed matching of a dry lamination. A dry lamination process may be a process of bonding a foil material 112 with a printable substrate 106 through a dry bonding process. Initially the adhesive material 110 is applied on either the printable substrate 106 or the foil material 112, and then dried under the ultraviolet lamp prior to being combined with the second substrate. The foil material 112 and the printable substrate 106 are combined after the adhesive material 110 is completely dried for maximum efficiency of the dry lamination process, according to one embodiment.

A wet lamination process may be a process of bonding a foil material 112 with a printable substrate 106 through a wet bonding process. The foil material 112 may be affixed onto the adhesive material 110 previously applied onto printable substrate 106 prior to pass under the ultraviolet curing lamp 122, which may be used for fully curing the adhesive material 110. This curing process may make the adhesive material(s) 110 dry, adhere the foil material 112 and the printable substrate 106 together. Therefore, the foil material 112 and the printable substrate 106 need to be combined before the adhesive material 110 may be dried in the ultraviolet curing lamp 122, according to one embodiment.

In one embodiment, the improved wet lamination process is demonstrated here to produce the output result in a single pass process. In improved wet lamination process, both ultraviolet pinning lamp 118 and ultraviolet curing lamp 122 may be used to cure the adhesive material 110 applied onto the printable substrate 106 to affix the foil material 112 onto the printable substrate 106. Initially, the pigmented ink 108 and adhesive material 110 may be applied onto the printable substrate 106 is partially cured by passing the printable substrate 106 under the ultraviolet pinning lamp 118 (ultraviolet lamp operable at low intensity i.e., between 2 and 4 watts per centimeter square (2 W/cm$^2$ and 4 W/cm$^2$)). This may make the adhesive material 110 to retain its ability to affix properly the foil material 112 onto the printable substrate 106, according to one embodiment.

The printable substrate 106 with a foil material 112 affixed may be fully cured by passing the printable substrate 106 under the ultraviolet curing lamp 122 (ultraviolet lamp operable at approximately 12 watts per centimeter square (12 W/cm$^2$)). As a result, a high intensity ultraviolet light may be used to create a photochemical reaction that may instantly cure the pigmented ink 108 and adhesive material 110 onto the printable substrate 106, according to one embodiment.

The whole process of applying the pigmented ink 108 and adhesive material 110 through printer head 104, partially curing the adhesive material 110 through ultraviolet pinning lamp 118, affixing the foil material 112 onto the printable substrate 106 using a nip roller 120, fully curing the adhesive material 110 through ultraviolet curing lamp 122 and properly laminate the printable substrate 106 with the foil material 112 in a wet lamination process and excess foil material 206 is rolled back using a rollback mechanism 124 is completely done in a single pass process, according to one embodiment.

FIG. 3 is a partial view 350 of different sections of inkjet printer 102 involved in printing of a digital data 114 onto a printable substrate 106. Particularly, FIG. 3 shows a UV Curing 302 and an affixed foil material 304. The ultraviolet curing (also known as UV Curing 302) may be a photochemical process in which low and high intensity ultraviolet light may be used to instantly cure or dry inks and adhesive material 110 placed on a printable substrate 106 to affix the foil material 112. The affixed foil material 304 may be the foil material 112 which is placed on printable substrate 106 with the adhesive material 110 may be forwarded to pass under ultraviolet curing lamp 122 to fully cure, according to one embodiment.

Figure 3A:
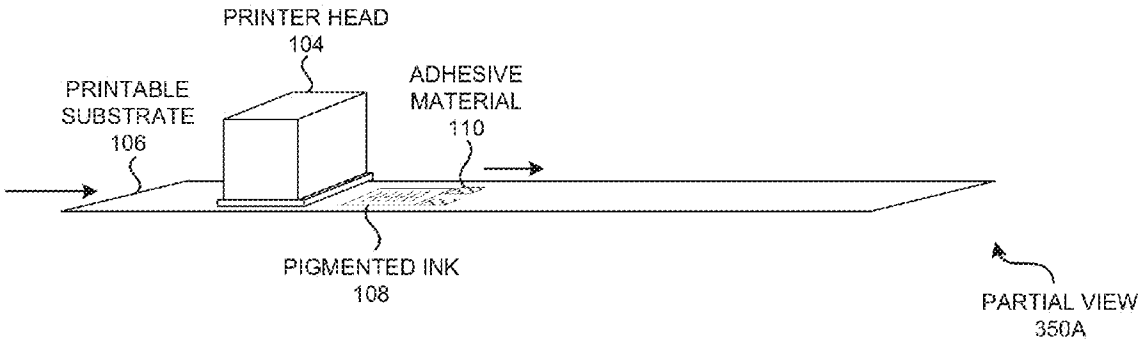
FIG. 3A is a partial view of a printer head illustrating the input of pigmented ink and the adhesive material on the printable substrate of FIG. 1, according to one embodiment.

FIG. 3A is a partial view of a printer head illustrating the input of pigmented ink and the adhesive material on the printable substrate of FIG. 1, according to one embodiment. A printer head 104 of the inkjet printer 102 may be a single unit which is wide enough to cover a width of a printable substrate 106 area on which the adhesive material 110 and pigmented ink 108 may be deposited. The printer head 104 may be constructed from multiple individual print heads each serially coupled with each other to form the print head. Further the printer head 104 may also be a monochromatic print head, a single purpose adhesive print head, a multifunctional print head, and/or a multicolor print head, etc. The adhesive material 110 and pigmented ink 108 deposited onto the printable substrate 106 may be in response to a digital data 114 received from a computing system 116 in a single pass process, according to one embodiment.

Figure 3B:
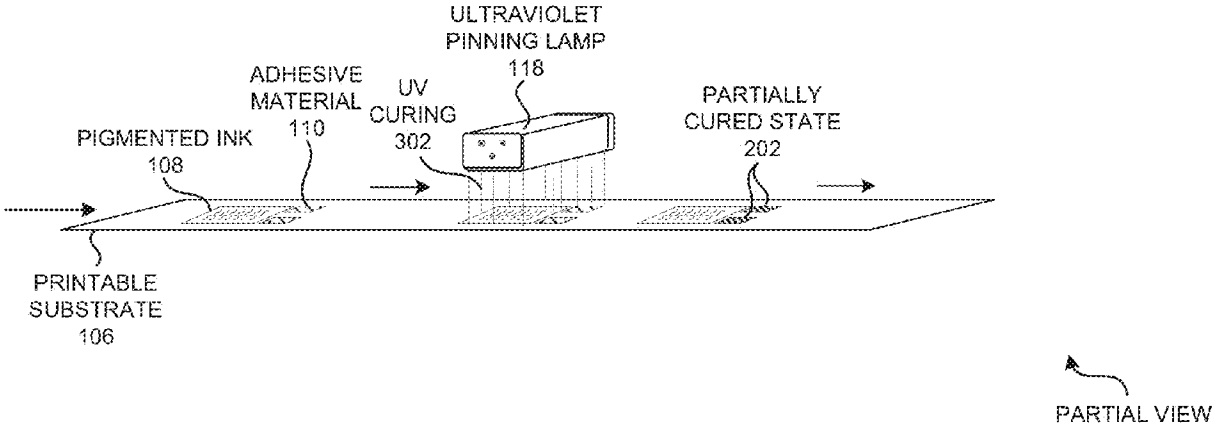
FIG. 3B is a partial view of ultraviolet pinning lamp to partially cure the applied adhesive on the printable substrate of FIG. 1, according to one embodiment.

FIG. 3B is a partial view of ultraviolet pinning lamp to partially cure the applied adhesive on the printable substrate of FIG. 1, according to one embodiment. The adhesive material 110 present on the printable substrate 106 is then allowed to pass through the ultraviolet pinning lamp 118 under partially cured state 202 where the printable substrate 106 is operated at a low intensity ultraviolet lamp i.e., between 2 and 4 watts per centimeter square (4 W/cm$^2$). This may result in retaining the ability of adhesive to affix the foil material 112 more efficiently onto the printable substrate 106, according to one embodiment.

Figure 3C:
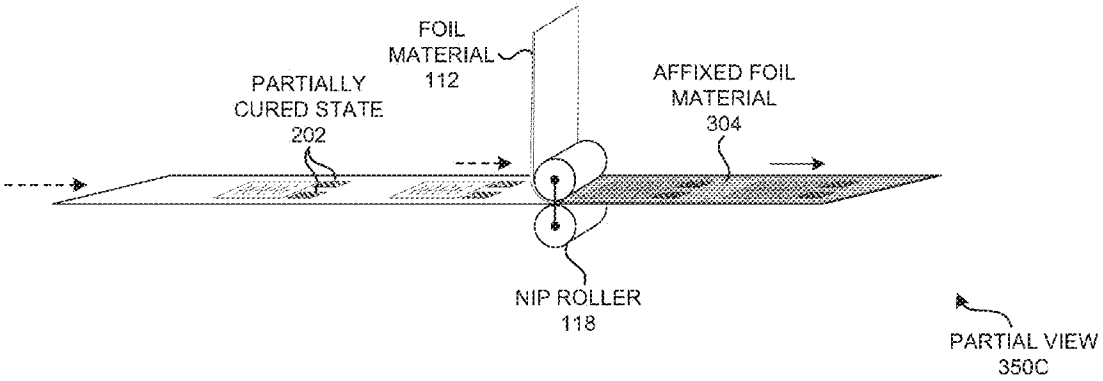
FIG. 3C is a partial view of a nip roller to affix the foil material with the adhesive material onto the printable substrate of FIG. 1, according to one embodiment.

FIG. 3C is a partial view of a nip roller to affix the foil material with the adhesive material onto the printable substrate of FIG. 1, according to one embodiment. The foil material 112 may be allowed to affix onto the printable substrate 106 with the adhesive material 110 using the nip roller 120. The high pressure created at the nip points may bring the printable substrate 106 and the foil material 112 into intimate contact without causing any defective bond, according to one embodiment.

Figure 3D:
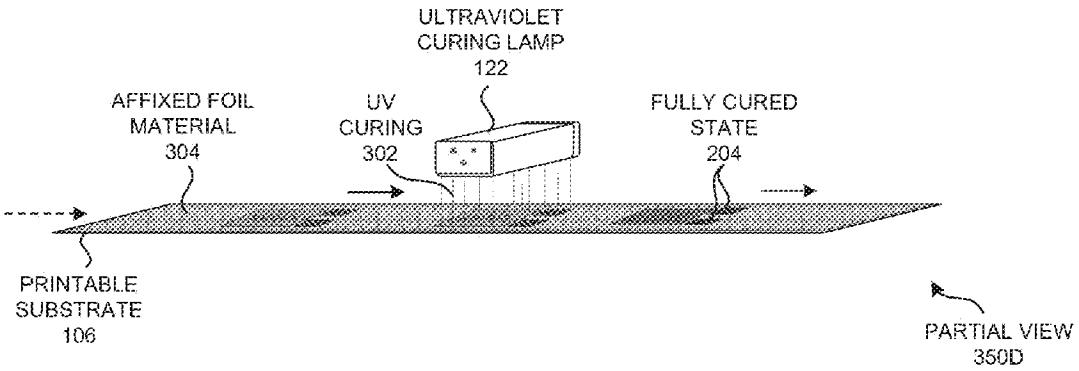
FIG. 3D is a partial view of ultraviolet curing lamp to fully cure the adhesive material applied onto the printable substrate of FIG. 1, according to one embodiment.

FIG. 3D is a partial view of ultraviolet curing lamp to fully cure the adhesive material applied onto the printable substrate of FIG. 1, according to one embodiment. The affixed foil material 304 with the adhesive material 110 onto the printable substrate 106 is then fully cured under the ultraviolet curing lamp 122 by operating the lamp at high intensity of approximately 12 watts per centimeter square (12 W/cm$^2$). This may result in proper fixing of foil material 112 onto the printable substrate 106 with proper curing of the adhesive material 110 to form a laminated product, according to one embodiment.

Figure 3E:
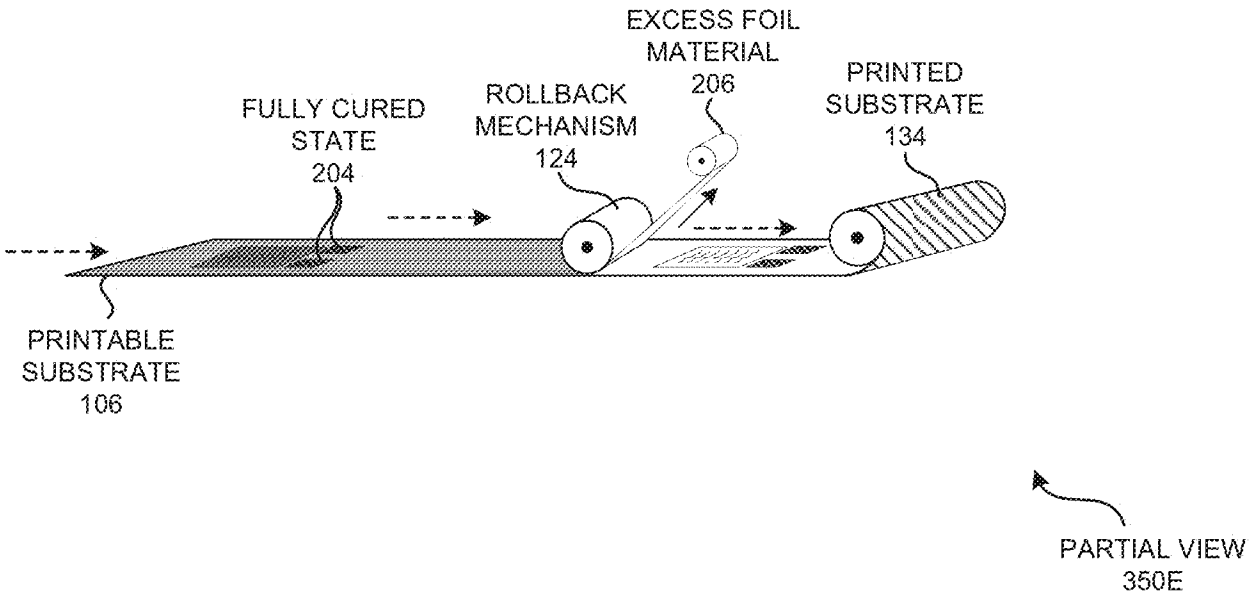
FIG. 3E is a partial view of rollback mechanism to remove excess foil material left on the printable substrate of FIG. 1, according to one embodiment.

FIG. 3E is a partial view of rollback mechanism to remove excess foil material 206 left on the printable substrate of FIG. 1, according to one embodiment. After fully curing the printable substrate 106 with the excess foil material 206 remained after curing on the printable substrate 106 is collected. The excess foil material 206 may be rolled back through the rollback mechanism 124 and the final product is collected adjacent to it in the form of printed substrate 134, according to one embodiment.

Figure 4:
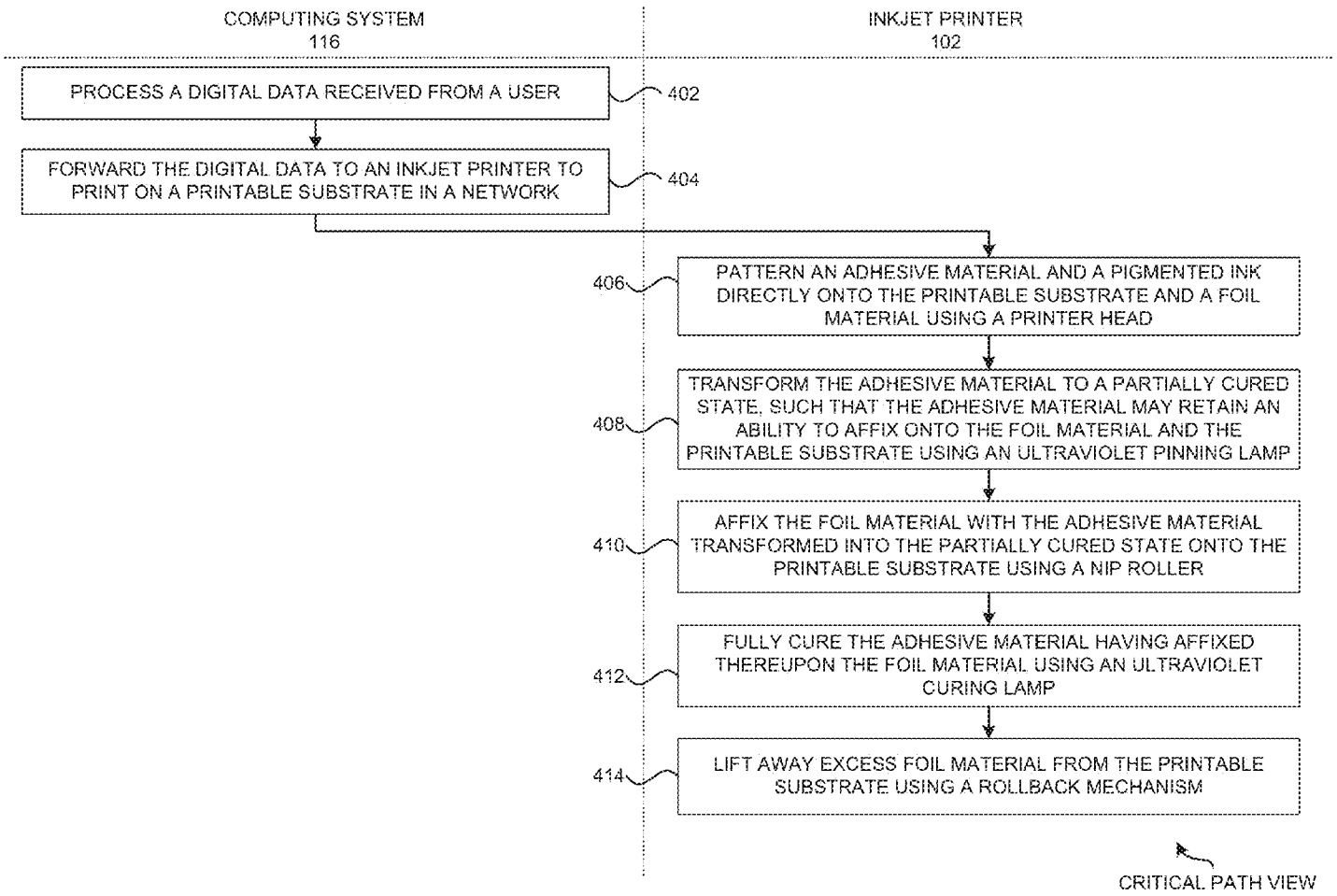
FIG. 4 is a critical path view of printing and applying the adhesive material simultaneously on the printable substrate and curing it in the single pass process of FIG. 1, according to one embodiment.

FIG. 4 is a critical path view of printing and applying the adhesive material simultaneously on the printable substrate and curing it in the single pass process of FIG. 1, according to one embodiment. In operation 402, the computer system processes the digital data 114 in the computing system 116, according to one embodiment. In operation 404, the digital data 114 from computing system 116 is forwarded to inkjet printer 102 to print on a printable substrate 106 in a network 101, according to one embodiment. In operation 406, the print head of inkjet printer 102 patterns an adhesive material 110 and a pigmented ink 108 directly onto the printable substrate 106 and a foil material 112, according to one embodiment.

In operation 408, the ultraviolet pinning lamp 118 of the inkjet printer 102 transforms the adhesive material 110 to a partially cured state 202 which retains an ability of adhesive material 110 to affix onto the foil material 112 and the printable substrate 106, according to one embodiment. In operation 410, the nip roller 120 of the inkjet printer 102 affixes the foil material 112 with the adhesive material 110 transformed into the partially cured state 202 onto the printable substrate 106, according to one embodiment. In operation 412, the ultraviolet curing lamp 122 of inkjet printer 102 fully cures the adhesive material 110 affixed thereupon the foil material 112, according to one embodiment. In operation 414, the rollback mechanism 124 of inkjet printer 102 lifts away the excess foil material 206 from the printable substrate 106, according to one embodiment.

Figure 5:
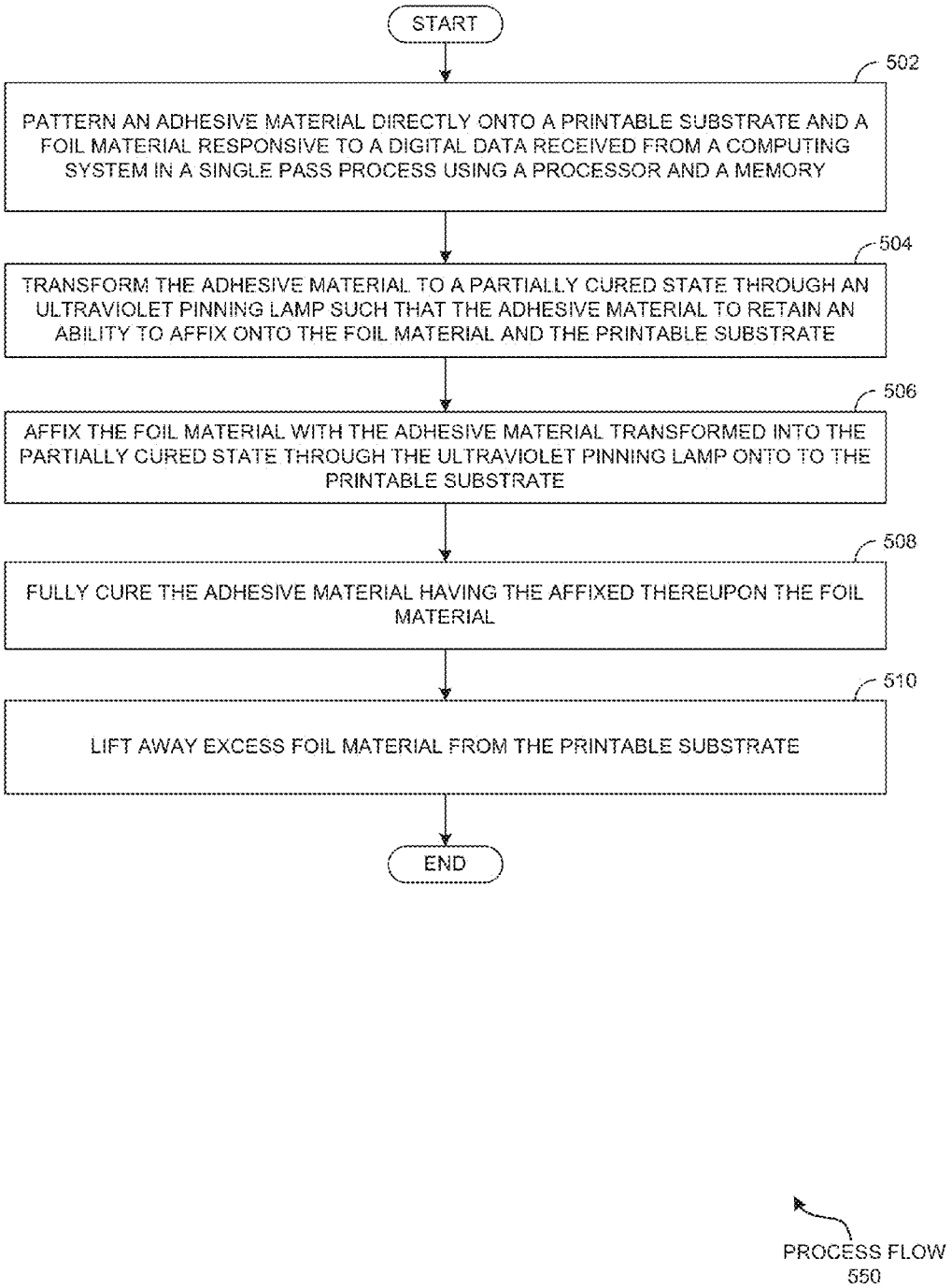
FIG. 5 is a process flow view of the single pass inkjet method of applying the adhesive mat to the printable substrate to bond the foil material to the printable substrate of FIG. 1, according to one embodiment.

FIG. 5 is a process flow view of the single pass inkjet method of applying the adhesive material to the able substrate to bond the foil material to the printable substrate of FIG. 1, according to one embodiment. In operation 502, an adhesive material 110 is patterned directly onto a printable substrate 106 and a foil material 112 responsive to a digital data 114 received from a computing system 116 in a single pass process using a processor 130 and a memory 128, according to one embodiment. In operation 504, the adhesive material 110 is transformed to a partially cured state 202 through an ultraviolet pinning lamp 118 such that the adhesive material 110 to retain an ability to affix onto the foil material 112 and the printable substrate 106, according to one embodiment.

In operation 506, the foil material 112 is affixed with the adhesive material 110 transformed into the partially cured state 202 through the ultraviolet pinning lamp 118 onto to the printable substrate 106, according to one embodiment. In operation 508, the adhesive material 110 having the affixed thereupon the foil material 112 is fully cured, according to one embodiment. In operation 510, the excess foil material 206 from the printable substrate 106 is lifted away, according to one embodiment.

As an example embodiment, the Lone Star Print Shop in Austin Tex. may be preferred vendor for businesses seeking to develop and print creative marketing collateral. The Lone Star Print Shop may find that specialized print effects (e.g., metallic textures, scratch off surfaces, holofoils, glitter effects, mirrored surfaces) on a printed material (e.g., a plastic card, a paper, a poster) may be eye-catching and desired by customers in the Austin Tex. area. Further, Lone Star Print Shop may find that specialized print effects may add a sense of higher value to different types of printing (e.g., book covers, promotional items, labels, posters).

Thanks to the various embodiments described with respect to FIGS. 1-6 the Lone Star Print Shop may now be able to print specialized print effects without needing complex and expensive screen printing methods. In addition, the Lone Star Print Shop may not need to use screen printing methods that involve extensive set up and/or preparation time to achieve specialized effects. Therefore, Lone Star Print Shop may be able to service customers seeking low quantity printing. Moreover, the Lone Star Print Shop may not need to purchase screen printing equipment that may be expensive to purchase and maintain.

Further, thanks to the various embodiments described with respect to FIGS. 1-6, the Lone Star Print Shop may be able to use inkjet technology for specialized printing. For example, specialized inks described in the various embodiments of FIGS. 1-6 may work well in inkjet printer(s) 102. The various inks described in conjunction with the embodiments of FIGS. 1-6 may not be highly reflective and may not create large flakes of abrasive-edged metal therefore preventing damage and clogging in inkjet print heads. Further, such inks described in conjunction with the embodiments of FIGS. 1-6 may avoid undesired dithering, spluttering, dot gain, smear, and resolution loss effects. Therefore, Lone Star Print Shop may capture significant market opportunities, and continue to operate profitably in the Austin, Tex. market, thanks to the various embodiments of FIGS. 1-6.

Figure 6:
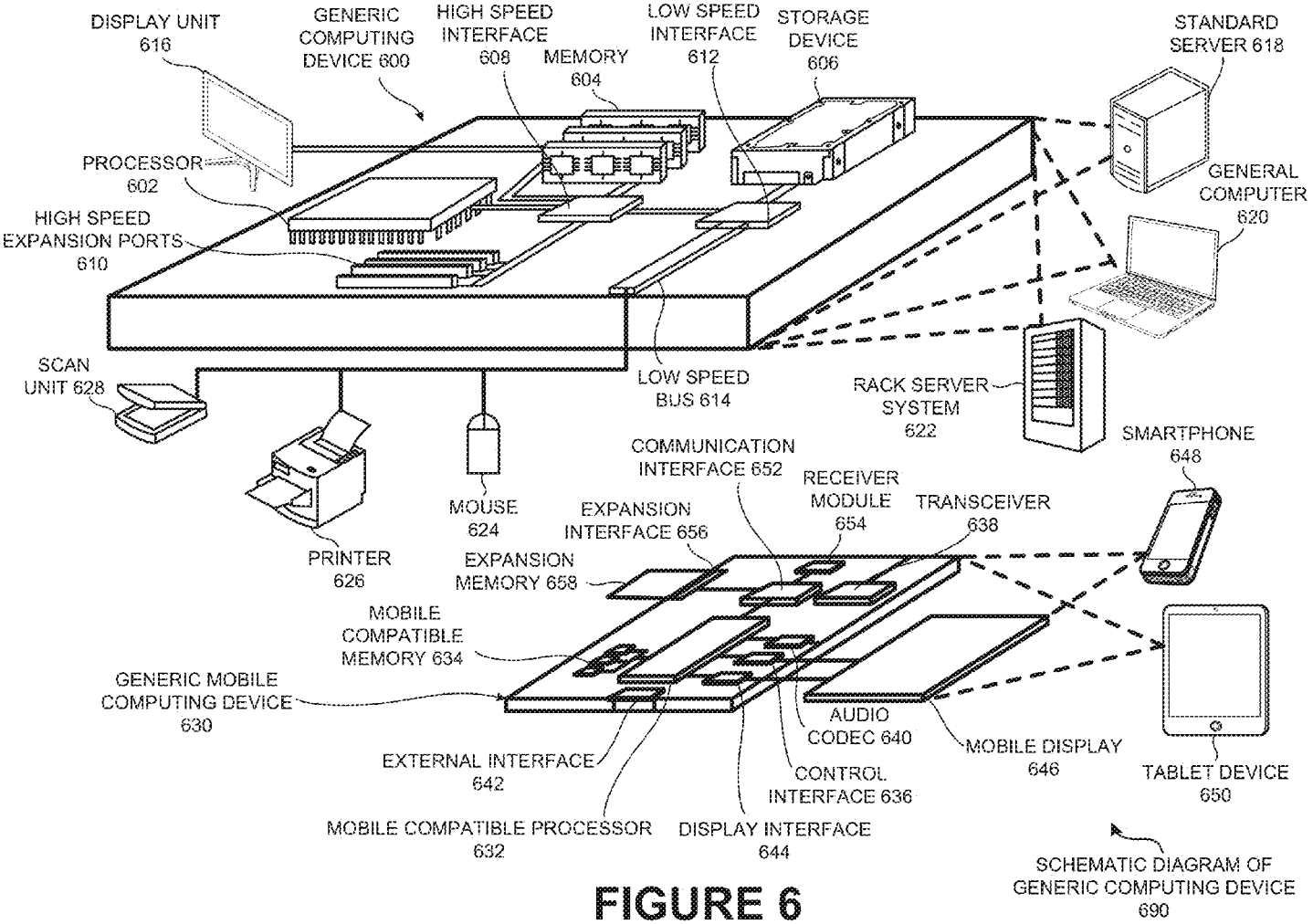
FIG. 6 is a schematic diagram of exemplary data processing that can be used to implement the methods and systems disclosed in FIG. 1, according to one embodiment.

FIG. 6 is a schematic of a computing device 600 and a mobile device 650 that can be used to perform and/or implement any of the embodiments disclosed in FIG. 1, according to one embodiment. The computing device 600 may represent various forms of digital computers, such as laptops, desktops, workstations, personal digital assistants, servers, blade servers, mainframes, and/or other appropriate computers. The mobile device 650 may represent various forms of mobile devices, such as smartphones, camera phones, personal digital assistants, cellular telephones, and other similar mobile devices. The components shown here, their connections, couples, and relationships, and their functions, are meant to be exemplary only, and are not meant to limit the embodiments described and/or claimed.

The computing device 600 may include a processor 602, a memory 604 (e.g., memory 128 of FIG. 1), a storage device 606, a high speed interface 608 coupled to the memory 604 (e.g., memory 128 of FIG. 1) and a plurality of high speed expansion ports 610, and a low speed interface 612 coupled to a low speed bus 614 and a storage device 606. In one embodiment, each of the components heretofore may be inter-coupled using various buses, and may be mounted on a common motherboard and/or in other manners as appropriate. The processor 602 may process instructions for execution in the computing device 600, including instructions stored in the memory 604 (e.g., memory 128 of FIG. 1) and/or on the storage device 606 to display a graphical information for a GUI on an external input/output device, such as a display unit 616 coupled to the high speed interface 608. In other embodiments, multiple processors and/or multiple buses may be used, as appropriate, along with multiple memories and/or types of memory. Also, a plurality of computing device(s) 600 may be coupled with, with each device providing portions of the necessary operations (e.g., as a server bank, a group of blade servers, and/or a multi-processor system).

The memory 604 (e.g., memory 128 of FIG. 1) may be coupled to the computing device 600. In one embodiment, the memory 604 (e.g., memory 128 of FIG. 1) may be a volatile memory. In another embodiment, the memory 604 may be a non-volatile memory. The memory 604 (e.g., memory 128 of FIG. 1) may also be another form of computer-readable medium, such as a magnetic and/or an optical disk. The storage device 606 may be capable of providing mass storage for the computing device 600. In one embodiment, the storage device 606 may be comprised of at least one of a floppy disk device, a hard disk device, an optical disk device, a tape device, a flash memory and/or other similar solid state memory device. In another embodiment, the storage device 606 may be an array of the devices in a computer-readable medium previously mentioned heretofore, computer-readable medium, such as, and/or an array of devices, including devices in a storage area network and/or other configurations.

A computer program may be comprised of instructions that, when executed, perform one or more methods, such as those described above. The instructions may be stored in at least one of the memory 604 (e.g., memory 128 of FIG. 1), the storage device 606, a memory coupled to the processor 602, and/or a propagated signal.

The high speed interface 608 may manage bandwidth-intensive operations for the computing device 600, while the low speed interface 612 may manage lower bandwidth-intensive operations. Such allocation of functions is exemplary only. In one embodiment, the high speed interface 608 may be coupled to at least one of the memory 604 (e.g., memory 128 of FIG. 1), the display unit 616 (e.g., through a graphics processor and/or an accelerator), and to the plurality of high speed expansion ports 610, which may accept various expansion cards. In the embodiment, the low speed interface 612 may be coupled to at least one of the storage device 606 and the low speed bus 614. The low speed bus 614 may be comprised of a wired and/or wireless communication port (e.g., a Universal Serial Bus ("USB"), a Bluetooth® port, an Ethernet port, and/or a wireless Ethernet port). The low speed bus 614 may also be coupled to at least one of scan unit 628, a printer 626, a keyboard, a mouse 624, and a networking device (e.g., a switch and/or a router) through a network adapter.

The computing device 600 may be implemented in a number of different forms, as shown in the figure. In one embodiment, the computing device 600 may be implemented as a standard server 618 and/or a group of such servers. In another embodiment, the computing device 600 may be implemented as part of a rack server system 622. In yet another embodiment, the computing device 600 may be implemented as a general computer 620 such as a laptop or desktop computer. Alternatively, a component from the computing device 600 may be combined with another component in a mobile device 650. In one or more embodiments, an entire system may be made up of a plurality of computing device(s) 600 and/or a plurality of computing device(s) 600 coupled to a plurality of mobile device(s) 650.

In one embodiment, the mobile device 650 may comprise at least one of a mobile compatible processor 652, a mobile compatible memory 654, and an input/output device such as a mobile display 666, a communication interface 672, and a transceiver 658, among other components. The mobile device 650 may also be provided with a storage device, such as a microdrive or other device, to provide additional storage. In one embodiment, at least one of the components indicated heretofore are inter-coupled using various buses, and several of the components may be mounted on a common motherboard.

The mobile compatible processor 652 may execute instructions in the mobile device 650, including instructions stored in the mobile compatible memory 654. The mobile compatible processor 652 may be implemented as a chipset of chips that include separate and multiple analog and digital processors. The mobile compatible processor 652 may provide, for example, for coordination of the other components of the mobile device 650, such as control of user 126 interfaces, applications run by the mobile device 650, and wireless communication by the mobile device 650.

The mobile compatible processor 652 may communicate with a user 126 through the control interface 656 and the display interface 664 coupled to a mobile display 666. In one embodiment, the mobile display 666 may be at least one of a Thin-Film-Transistor Liquid Crystal Display ("TFT LCD"), an Organic Light Emitting Diode ("OLED") display, and another appropriate display technology. The display interface 664 may comprise appropriate circuitry for driving the mobile display 666 to present graphical and other information to a user 126. The control interface 656 may receive commands from a user 126 and convert them for submission to the mobile compatible processor 652. In addition, an external interface 662 may be provide in communication with the mobile compatible processor 652, so as to enable near area communication of the mobile device 650 with other devices. External interface 662 may provide, for example, for wired communication in some embodiments, or for wireless communication in other embodiments, and multiple interfaces may also be used.

The mobile compatible memory 654 may be coupled to the mobile device 650. The mobile compatible memory 654 may be implemented as at least one of a volatile memory and a non-volatile memory. The expansion memory 678 may also be coupled to the mobile device 650 through the expansion interface 676, which may comprise, for example, a Single In Line Memory Module ("SIMM") card interface. The expansion memory 678 may provide extra storage space for the mobile device 650, or may also store an application or other information for the mobile device 650. Specifically, the expansion memory 678 may comprise instructions to carry out the processes described above. The expansion memory 678 may also comprise secure information. For example, the expansion memory 678 may be provided as a security module for the mobile device 650, and may be programmed with instructions that permit secure use of the mobile device 650. In addition, a secure application may be provided on the SIMM card, along with additional information, such as placing identifying information on the SIMM card in a non-hackable manner.

The mobile compatible memory 654 may comprise at least one of a volatile memory (e.g., a flash memory) and a non-volatile memory (e.g., a non-volatile random-access memory ("NVRAM")). In one embodiment, a computer program comprises a set of instructions that, when executed, perform one or more methods. The set of instructions may be stored on at least one of the mobile compatible memory 654, the expansion memory 678, a memory coupled to the mobile compatible processor 652, and a propagated signal that may be received, for example, over the transceiver 658 and/or the external interface 662.

The mobile device 650 may communicate wirelessly through the communication interface 672, which may be comprised of a digital signal processing circuitry. The communication interface 672 may provide for communications using various modes and/or protocols, such as, at least one of: a Global System for Mobile Communications ("GSM") protocol, a Short Message Service ("SMS") protocol, an Enhanced Messaging System ("EMS") protocol, a Multimedia Messaging Service ("MMS") protocol, a Code Division Multiple Access ("CDMA") protocol, Time Division Multiple Access ("TDMA") protocol, a Personal Digital Cellular ("PDC") protocol, a Wideband Code Division Multiple Access ("WCDMA") protocol, a CDMA2000 protocol, and a General Packet Radio Service ("GPRS") protocol. Such communication may occur, for example, through the radio frequency transceiver. In addition, short-range communication may occur, such as using a Bluetooth®, Wi-Fi, and/or other such transceiver. In addition, a GPS ("Global Positioning System") receiver module may provide additional navigation-related and location-related wireless data to the mobile device 650, which may be used as appropriate by a software application running on the mobile device 650.

The mobile device 650 may also communicate audibly using an audio codec 660, which may receive spoken information from a user 126 and convert it to usable digital information. The audio codec 660 may likewise generate audible sound for a user 126, such as through a speaker (e.g., in a handset of the mobile device 650). Such a sound may comprise a sound from a voice telephone call, a recorded sound (e.g., a voice message, a music files, etc.) and may also include a sound generated by an application operating on the mobile device 650.

The mobile device 650 may be implemented in a number of different forms, as shown in the figure. In one embodiment, the mobile device 650 may be implemented as a smartphone 668. In another embodiment, the mobile device 650 may be implemented as a personal digital assistant ("PDA"). In yet another embodiment, the mobile device, 650 may be implemented as a tablet device 670.

Various embodiments of the systems and techniques described here can be realized in at least one of a digital electronic circuitry, an integrated circuitry, a specially designed application specific integrated circuits ("ASICs"), a piece of computer hardware, a firmware, a software application, and a combination thereof. These various embodiments can include embodiment in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications, and/or code) comprise machine-readable instructions for a programmable processor, and can be implemented in a high-level procedural and/or object-oriented programming language, and/or in assembly/machine language. As used herein, the terms "machine-readable medium" and/or "computer-readable medium" refers to any computer program product, apparatus and/or device (e.g., magnetic discs, optical disks, memory, and/or Programmable Logic Devices ("PLDs")) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user 126, the systems and techniques described here may be implemented on a computing device having a display device (e.g., a cathode ray tube ("CRT") and/or liquid crystal display ("LCD") monitor) for displaying information to the user 126 and a keyboard and a mouse by which the user 126 can provide input to the computer. Other kinds of devices can be used to provide for interaction with a user 126 as well; for example, feedback provided to the user 126 can be any form of sensory feedback (e.g., visual feedback, auditory feedback, and/or tactile feedback) and input from the user 126 can be received in any form, including acoustic, speech, and/or tactile input.

The systems and techniques described here may be implemented in a computing system 116 that comprises at least one of a back end component (e.g., as a data server), a middleware component (e.g., an application server), a front end component (e.g., a client computer having a graphical user interface, and/or a Web browser through which a user 126 can interact with an embodiment of the systems and techniques described here), and a combination thereof. The components of the system may also be coupled through a communication network.

The communication network may comprise at least one of a local area network ("LAN") and a wide area network ("WAN") (e.g., the Internet). The computing system 116 can comprise at least one of a client and a server. In one embodiment, the client and the server are remote from each other and interact through the communication network.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. An inkjet printer, comprising:

a printer head to pattern an adhesive material directly onto at least one of a printable substrate and a foil material, responsive to a digital data received from a computing system in a single pass process;

an ultraviolet pinning lamp to transform the adhesive material to a partially cured state, such that the adhesive material retains an ability to affix the foil material onto the printable substrate;

a nip roller to affix the foil material with the adhesive material transformed into the partially cured state through the ultraviolet pinning lamp onto to the printable substrate;

an ultraviolet curing lamp to fully cure the adhesive material having the foil material affixed thereupon; and a rollback mechanism to lift away excess foil material from the printable substrate, wherein the excess foil material is adjacent to fully cured areas of the adhesive material having the foil material affixed thereupon.

2. The inkjet printer of claim 1, wherein the printer head simultaneously deposits a pigmented ink as well as the adhesive material during the single pass process.

3. The inkjet printer of claim 2, where a substrate is continuously fed through the inkjet printer in a forward fashion at a constant rate of speed during operation of the inkjet printer to facilitate high speed inkjet printing tasks, and wherein the single pass process to deposit the adhesive material and, optionally the pigmented ink, at a rate matching the constant rate of speed of the substrate feeding through the inkjet printer in the forward fashion.

4. The inkjet printer of claim 3, wherein the printer head is a single unit which is wide enough to cover a width of a substrate area on which the adhesive material is deposited onto the substrate.

5. The inkjet printer of claim 3, wherein the printer head is constructed from multiple individual print heads each serially coupled with each other to form the print head.

6. The inkjet printer of claim 1, wherein the substrate is any one of a plastic card, a paper stock, a wood material, a metallic material, a polymer based surface, an organic surface, a cloth material, a ceramic material, and a magnetic material.

7. The inkjet printer of claim 1, wherein the print head is any one of a monochromatic print head, a single purpose adhesive print head, a multifunctional print head, and a multicolor print head.

8. The inkjet printer of claim 1, wherein the ultraviolet pinning lamp to operate between 2 and 4 watts per centimeter square (4 W/cm$^2$), wherein the ultraviolet curing lamp to operate at approximately 12 watts per centimeter square (12 W/cm$^2$).

9. The inkjet printer of claim 1, wherein the foil material to produce a specialized print effect demonstrating crisp characters and graphics through the partial curing through the ultraviolet pinning lamp, wherein the specialized print effect created with the foil material is any one of a metallic texture, a scratch off surface, a holofoil, a glitter effect, and a mirrored surface effect, and wherein the foil material is any one of a hot transfer foil and a cold transfer foil.

10. The inkjet printer of claim 1, wherein the inkjet printer to demonstrate the fast curing benefits of a wet lamination process while minimizing risks of ink surface tension and mechanical speed matching of a dry lamination process, wherein the adhesive material is comprised of 5-20% hexanediol diacrylate, 5-30% alkoxylated monomer diacrylate, 5-50% vinylcaprolactam, 30-50% triacrylate monomer, 1-10% phosphine oxide, and 0-7% carbon color material compound, and wherein the adhesive material is producible in at least one of a color form, an opaque form, a translucent form, and a transparent form.

11. An inkjet printer, comprising:

a printer head to pattern an adhesive material directly onto at least one of a printable substrate and a foil material, responsive to a digital data received from a computing system in a single pass process;

an ultraviolet curing lamp to cure the adhesive material using at least one of a dry lamination process and a wet lamination process; and a nip roller to affix the foil material with the adhesive material onto the printable substrate;

a rollback mechanism to lift away excess foil material from the printable substrate, wherein the excess foil material is adjacent to fully cured areas of the adhesive material having the foil material affixed thereupon.

12. The inkjet printer of claim 11, wherein the printer head simultaneously deposits a pigmented ink as well as the adhesive material during the single pass process.

13. The inkjet printer of claim 12:

wherein a substrate is continuously fed through the inkjet printer in a forward fashion at a constant rate of speed during operation of the inkjet printer to facilitate high speed inkjet printing tasks, and wherein the single pass process to deposit the adhesive material and, optionally the pigmented ink, at a rate matching the constant rate of speed of the substrate feeding through the inkjet printer in the forward fashion.

14. The inkjet printer of claim 13, wherein the printer head is a single unit which is wide enough to cover a width of a substrate area on which the adhesive material is deposited onto the substrate.

15. The inkjet printer of claim 13, herein the printer head is constructed from multiple individual print heads each serially coupled with each other to form the print head.

16. A method, comprises:

patterning an adhesive material directly onto at least one of a printable substrate and a foil material, using a printer head responsive to a digital data received from a computing system in a single pass process using a processor and a memory;

transforming the adhesive material to a partially cured state through an ultraviolet pinning lamp such that the adhesive material retains an ability to affix the foil material onto the printable substrate;

affixing the foil material with the adhesive material transformed into the partially cured state through the ultraviolet pinning lamp onto the printable substrate;

fully curing the adhesive material having the foil material affixed thereupon; and lifting away excess foil material from the printable substrate, wherein the excess foil material is adjacent to fully cured areas of the adhesive material having the foil material affixed thereupon.

17. The method of claim 16 further comprising:

simultaneously depositing a pigmented ink as well as the adhesive material during the single pass process.

18. The method of claim 17, continuously feeding a substrate through the inkjet printer in a forward fashion at a constant rate of speed during operation of the inkjet printer to facilitate speed inkjet printing tasks; and depositing the adhesive material and, optionally the pigmented ink, at a rate matching the constant rate of speed of the substrate feeding through the inkjet printer in the forward fashion through the single pass process.

19. The inkjet printer of claim 18, wherein the printer head is a single unit which is wide enough to cover a width of a substrate area on which the adhesive material is deposited onto the substrate.

20. The inkjet printer of claim 18, wherein the printer head is constructed from multiple individual print heads each serially coupled with each other to form the print head.

* * * * *